US006422349B1

(12) United States Patent
Veletovac

(10) Patent No.: US 6,422,349 B1
(45) Date of Patent: Jul. 23, 2002

(54) HYDROSTATIC DISPLACEMENT DRIVE FOR LIFTING AND LOWERING AND HOLDING LOADS, IN PARTICULAR FOR LIFTS

(75) Inventor: Sead Veletovac, Dübendorf (CH)

(73) Assignee: Wittur GmbH, Wiedenzhausen (DE)

( * ) Notice: Subject to any disclaimer, the term of this patent is extended or adjusted under 35 U.S.C. 154(b) by 0 days.

(21) Appl. No.: 09/432,059

(22) Filed: Oct. 29, 1999

Related U.S. Application Data

(63) Continuation-in-part of application No. PCT/CH98/00173, filed on Apr. 28, 1998.

(30) Foreign Application Priority Data

Apr. 30, 1997 (CH) ..... 1004/97

(51) Int. Cl.[7] ..... B66B 9/04; F15B 15/14; F15B 11/036

(52) U.S. Cl. ..... 187/272; 187/274; 187/275; 92/110; 92/165 R; 92/168

(58) Field of Search ..... 187/272–275, 187/215, 229, 234; 92/110, 165 R, 168

(56) References Cited

U.S. PATENT DOCUMENTS

| | | | | | |
|---|---|---|---|---|---|
| 2,269,786 | A | * | 1/1942 | Rose | 187/274 |
| 3,331,292 | A | * | 7/1967 | Seablom | 92/110 X |
| 3,425,322 | A | * | 2/1969 | Zucchellini | 92/27 |
| 4,955,282 | A | * | 9/1990 | Ranson | 92/110 X |
| 5,860,491 | A | * | 1/1999 | Fletcher | 187/272 X |

FOREIGN PATENT DOCUMENTS

| | | | | | |
|---|---|---|---|---|---|
| DE | 1031945 | A | * | 8/1958 | 187/272 |
| DE | 3402853 | A1 | * | 2/1985 | 187/272 |
| JP | 58-113611 | A | * | 7/1983 | |

* cited by examiner

*Primary Examiner*—Eileen D. Lillis
*Assistant Examiner*—Thuy V. Tran
(74) *Attorney, Agent, or Firm*—Thomas R. Vigil; Walsh & Katz, Ltd.

(57) ABSTRACT

The hydraulic or pneumatic drive for lifting and lowering loads, in particular for lifts, has a working cylinder (11) forming a pressure chamber (14) connected to a pressure fluid source (39) and subjected to a pressure fluid. It also has a lifting piston (1) tightly guided in the working cylinder and a guide rod (15) arranged in the working cylinder. The guide rod (15) projects into the interior of the lifting piston (1) which tightly encloses the guide rod (15). The end (4) of the lifting piston (1) which projects into the pressure chamber (14) forms an annular face (5) which is subjected to pressure fluid. The interior of the lifting piston (1) forms an additional pressure chamber (7) subjected to pressure fluid and which is connected to its own pressure fluid source (40). The pressure fluid source connected to the working cylinder (11) delivers pressure fluid at a substantially constant pressure, whereas the pressure fluid source (40) connected to the additional pressure chamber (7) delivers pressure fluid at a variable pressure. The additional pressure chamber (7), subjected to pressure fluid, subdivides the total force needed to lift a load into two partial forces, one of which acts upon the annular face and the other in the interior of the lifting piston, close under the load. In this way, the partial force acting upon the entire length of the lifting piston and subjecting the piston to buckling is substantially reduced. It is thus possible to reduce the amount of material required without affecting buckling resistance.

8 Claims, 4 Drawing Sheets

Figure 1:
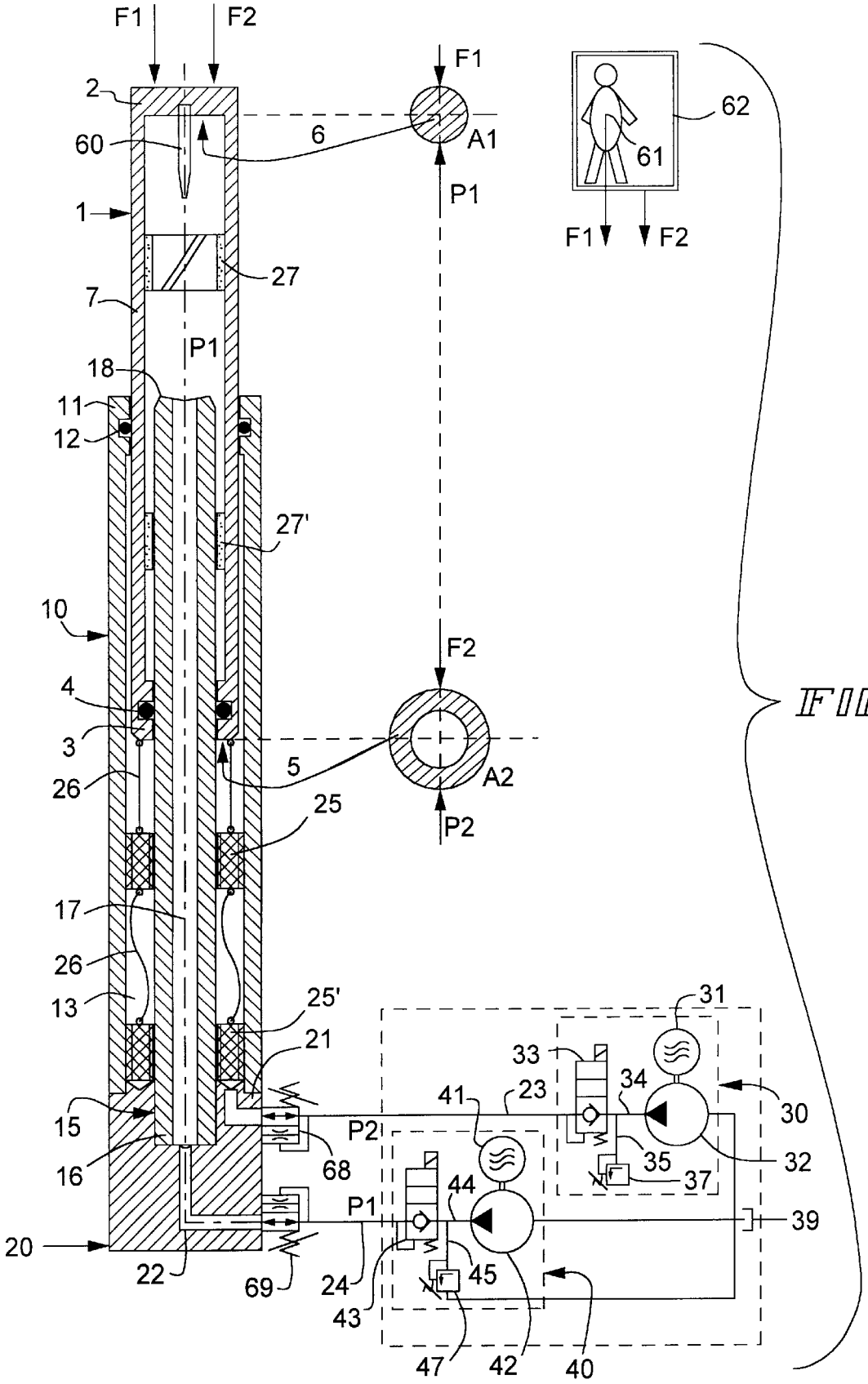

F1
F2
2
60
6
A1
P1
62
61
1
27
7
P1
18
17
27'
M
11'
12'
57'
77
A3
110'
P2
P2
4
F2
75'
3
P2
M
M
A2
5
P2
26
111
25
112

13
26
25'
110'
102
110
63
66
15
67
P2
16
P1+P2
21
102
P1
42
41
20''
22
101
43
47
46
39

HYDROSTATIC DISPLACEMENT DRIVE FOR LIFTING AND LOWERING AND HOLDING LOADS, IN PARTICULAR FOR LIFTS

This application is a continuation-in-part of PCT/CH98/00173 filed Apr. 28, 1998.

The invention concerns a hydrostatic drive for raising and lowering and holding loads, in particular for elevators, having a working cylinder which is connected to a pressure fluid source and which forms a pressure chamber acted upon by a pressure fluid, a lift piston sealingly guided in the working cylinder and a guide rod which is arranged in the working cylinder and which projects into the interior of the lift piston which sealingly embraces the guide rod, wherein the end of the lift piston which projects into the pressure chamber forms an annular face which is acted upon by pressure fluid.

Such a drive is known from Austrian patent specification No 385 018 which is intended for raising and lowering loads over great heights. In the case of that drive, the fact that the end of the lift piston which projects into the working cylinder slides sealingly on the guide rod is intended to improve the level of safeguard against bending or buckling. The large diameter of the massive lift piston, which is otherwise required because of the aspect of safeguarding against bending or buckling, is now replaced by the annular face which forms the working face of the lift piston. The lift piston which is hollow because of the annular face is not acted upon at the inside by the pressure fluid. In the known drive, in each lifting operation, the entire lifting force is applied solely by the pressure fluid which is in the pressure chamber of the working cylinder and which acts on the annular face and which is fed to the working cylinder under variable pressure. The entire lift force therefore acts here over the entire length of the lift piston. In order to ensure the safeguard against bending or buckling, the wall thickness of the lift piston must be of correspondingly large size. A disadvantage is that with changing length of the lift piston its working face area increases, the through-flow quantity increases and a larger pump is required.

U.S. Pat. No. 2,269,786 describes a hydrostatic drive in which provided in the working cylinder for the drive of the elevator cabin beside the pressure chamber surrounding the guide rod is a second pressure chamber which passes through the guide rod, in contrast to Austrian patent specification No 385 018 therefore the guide rod is not of a circular cross-section but an annular cross-section. The fact that a pressure chamber is disposed in the interior of the guide rod ensures a higher degree of safeguard against buckling or bending of the guide rod although the amount of material required for the guide rod is markedly reduced, which at the time involves a significant saving in weight. In hydraulic terms, disposed between the two pressure chambers is a pump which can be switched over in respect of its direction of rotation and which can pump hydraulic fluid between the two pressure chambers. One of the two pressure chambers of the drive is in communication with a second hydraulic drive carrying a weight which acts as a counterweight for the elevator cabin.

The object of the invention is to improve a known hydrostatic drive in regard to the safeguard against bending or buckling, so that even greater structural lengths are possible.

Figure 2:
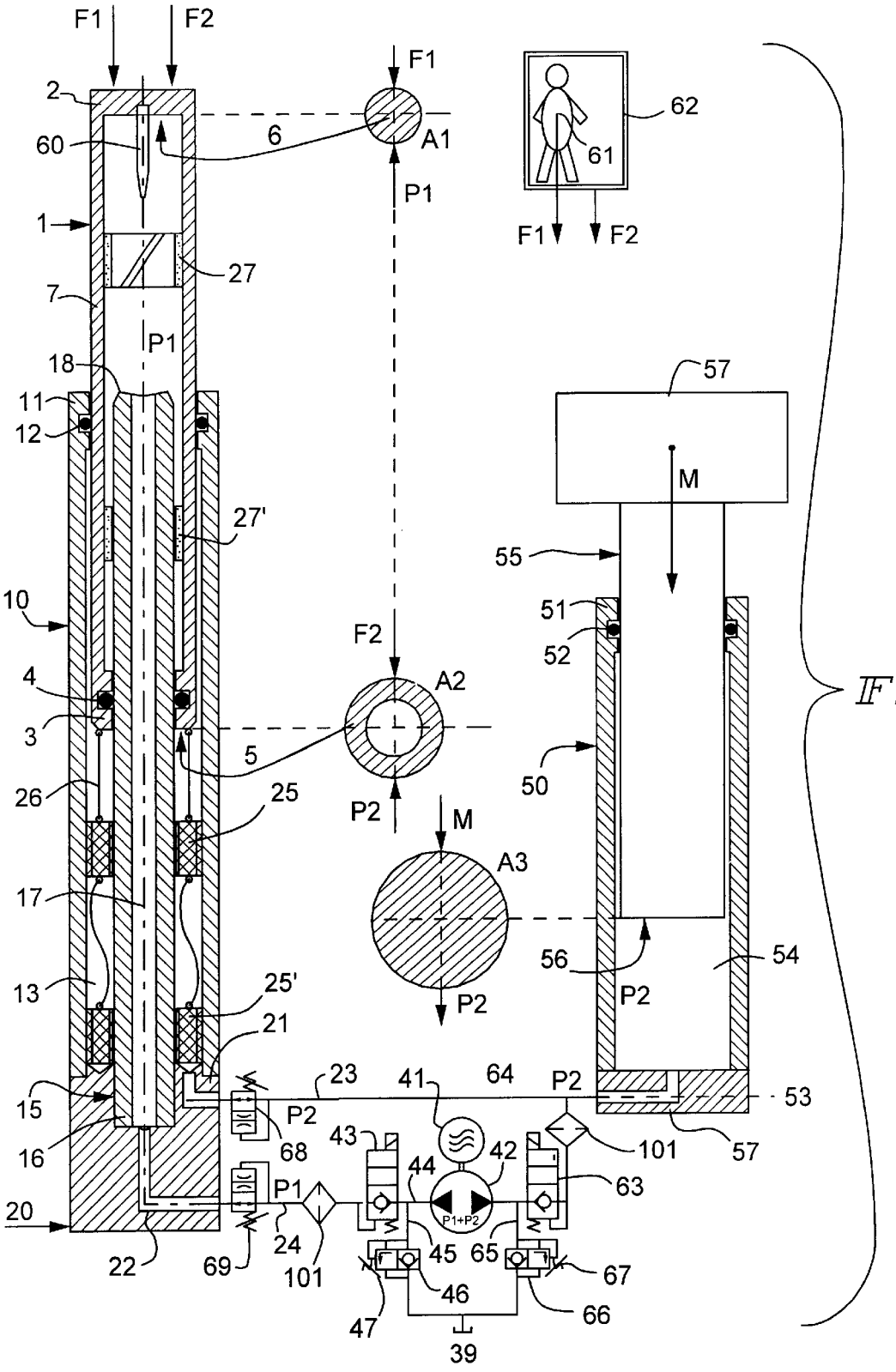
Figure 3:
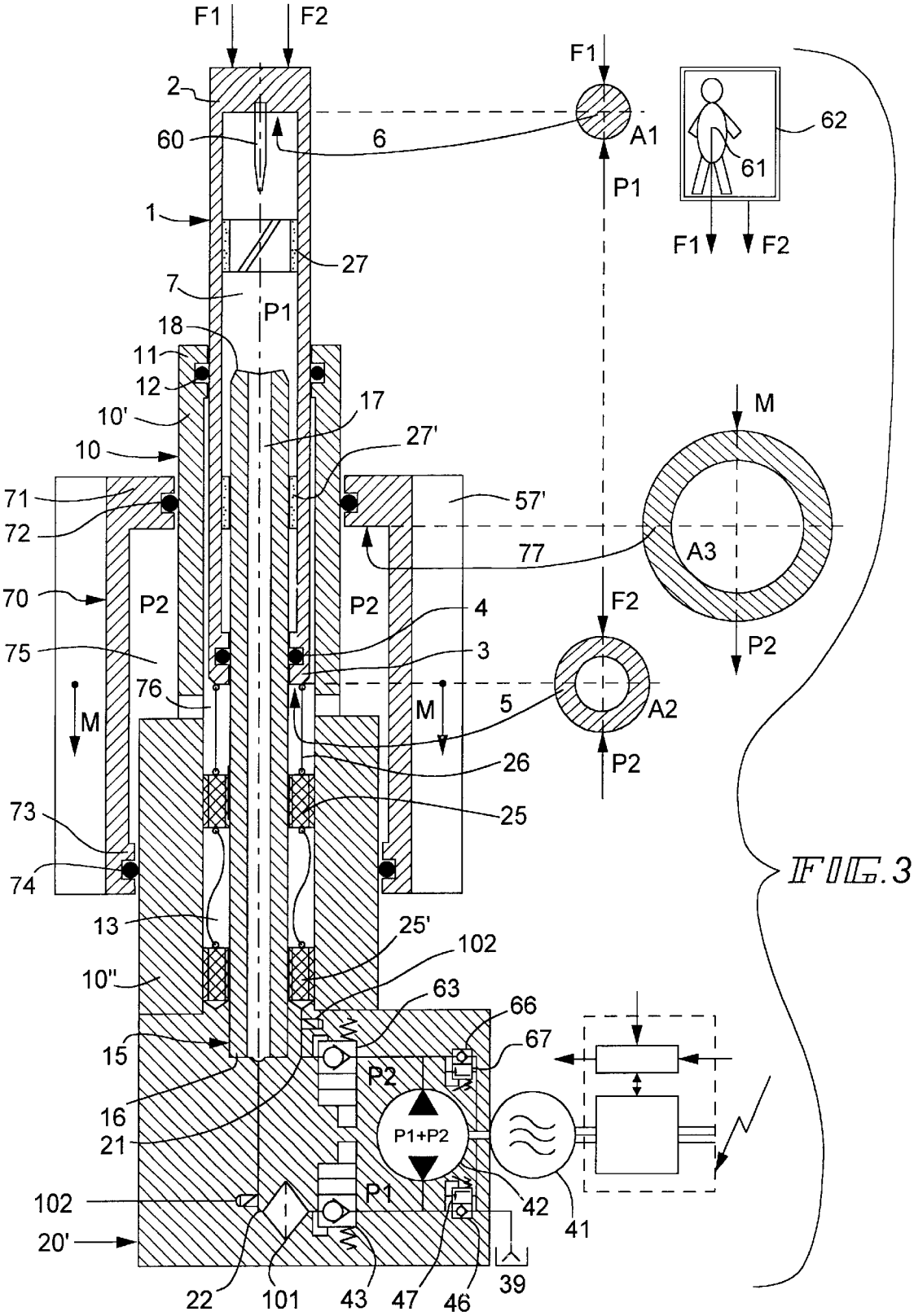
Figure 4:
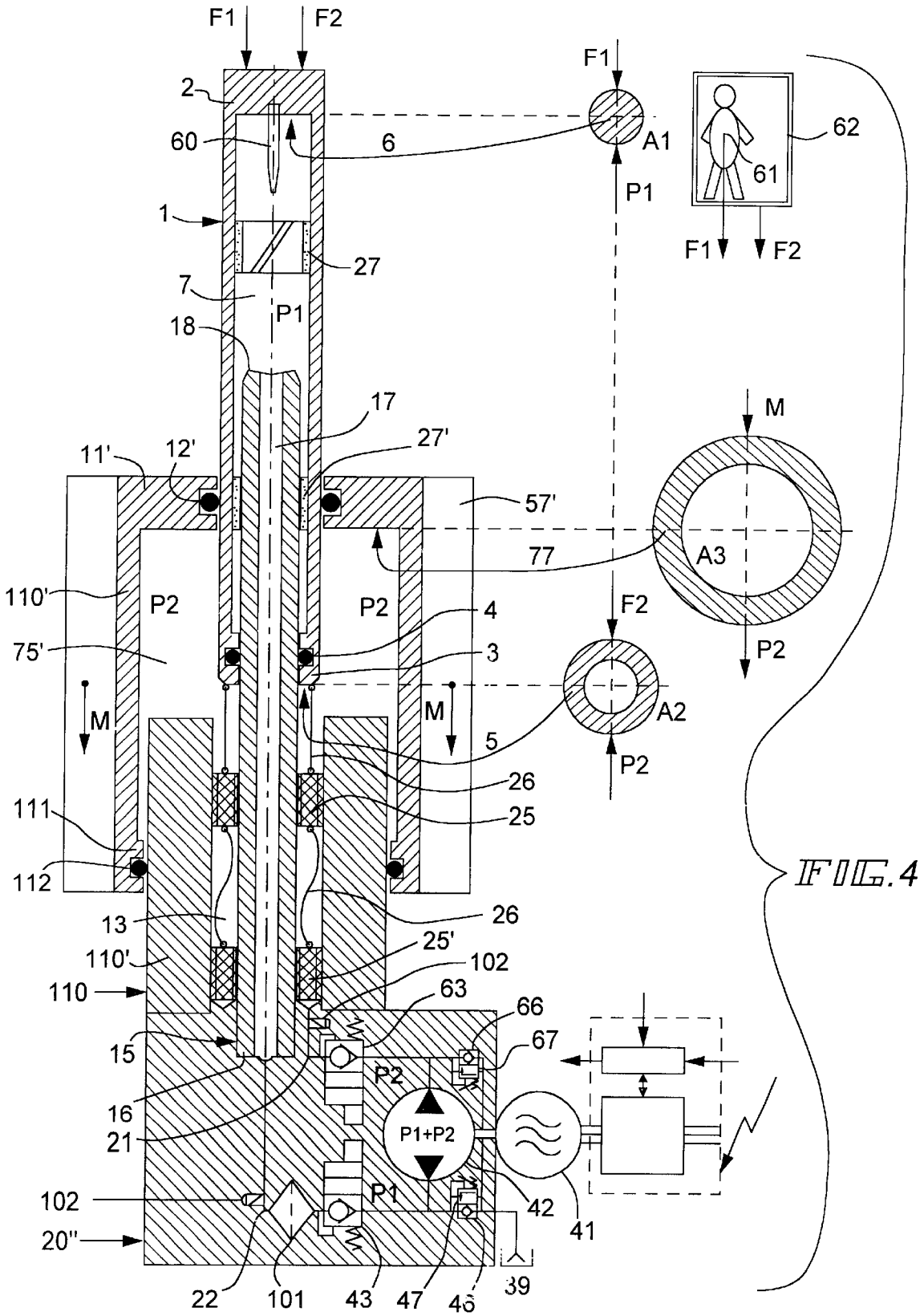

Some embodiments and further features of the invention are described in greater detail hereinafter with reference to the drawing in which:

FIG. 1 is a view in longitudinal section through a hydrostatic drive with two pressure chambers, and FIGS. 2 through 4 each show a view in longitudinal section through a respective hydrostatic drive, wherein each case the pressure fluid source which applies pressure fluid at substantially constant pressure is replaced by a counterweight which acts on a special piston-cylinder arrangement.

Referring to FIG. 1, as in U.S. Pat. No. 2,269,786 the hydrostatic drive has a hollow lift piston 1 which is closed at its upper end by and end wall 2. The lower end 3 of the vertically arranged lift piston 1 is somewhat thickened on its inner side and slidingly guided on a guide bar or rod 15 which is fixed with its lower end 16 in base plate 20 of a working cylinder 10. Let into the lower end 3 of the lift piston 1 is a sliding ring seal 4 so that the inner chamber of the lift piston 1, which acts as a pressure chamber, is sealingly separated from the interior of the working cylinder 10. The upper end 11 of the working cylinder 10 is also thickened on the inside and provided with a sliding ring seal 12 which bears against the outside of the lift piston 1. In that way the lift piston 1 is sealingly guided in the working cylinder 10. Provided in the base plate 20 of the working cylinder 10 is a bore 21 to which there is connected on the outside a pressure fluid line 23 which comes from a pressure fluid source 30 which supplies pressure fluid at a substantially constant pressure P2. The bore 21 opens into the interior of the working cylinder 10 which defines a pressure chamber 13. Provided in the base plate 20 is a further bore 22 to which there is connected on the outside a pressure fluid line 24 which comes from a second pressure fluid source 40 in the form of a delivery pump which supplies pressure fluid at variable pressure P1. The upper end of the bore 22 opens into an axial passage 17 which is provided in the guide bar 15 and which opens at its upper end 18 into the pressure chamber 7 of the lift piston 1.

The pressure source 30 comprises a delivery pump 32 which is driven by an electric motor 31 and which draws in pressure fluid from a tank 39 and conveys it by way of the pressure fluid line 23 into the pressure chamber 13 of the working cylinder 10. Disposed in the pressure fluid line 23 is a valve 33 which can be a switching or proportional directional control valve which in the illustrated position shuts off the flow of pressure fluid and which in other position allows pressure fluid to flow through to the pressure chamber 13. Between the delivery pump 32 and the valve 33 an overflow line 35 with excess pressure valve 36 branches from the line 34 and goes back to the tank 39. The delivery pump 42 is also driven by an electric motor 41 and draws pressure fluid from a tank 39. Arranged in its line 22 is a valve 43 which can be a switching or proportional directional control valve which similarly to the valve 33 can assume two limit positions. An overflow line 45 with an excess pressure valve 46 is also provided in relation to the delivery pump 42, similarly to the delivery pump 32. The delivery pump 42 supplies pressure fluid at a variable pressure P1 into the pressure chamber 7 of the lift piston 1.

In accordance with the invention disposed in the interior 13 of the working cylinder 10, depending on the respective requirements involved, is at least one spacer ring 25' which is suspended by way of flexible tension elements 26, for example wire cables, on the lower end of the lift piston 1. A further spacer ring 25, according to the requirements involved, is disposed in the same manner beneath the spacer ring 25, which in the illustrated position of the lift piston 1 is still resting on the base plate 20. The spacer rings 25 and 25' serve to prevent the guide rod 15 from buckling. They move slidingly upwardly and downwardly with the lift piston 1, wherein in the lowest position of the lift piston the spacer ring 25 can come to lie on the spacer ring 25'. The pressure fluid can be unimpededly propagated into the entire internal space 13 by way of preferably axial openings in the spacer rings 25 and 25'. The lift piston 1 is also provided, distributed over its length, with as required one or more spacer rings 27 which slide in the movement of the lift piston on the guide rod 15 and serve as protection to prevent buckling of the lift piston 1.

The pressure fluid under the pressure P2 in the pressure chamber 13 of the working cylinder 10 acts on an annular face 5 at the lower end of the lift piston 1. The face 5 forms an annular working face A2 as is shown at the right in FIG. 1. The internal space of the piston 1 forms the further pressure chamber 7 in which the pressure fluid of the pressure fluid source 40 acts with the variable pressure P1. Therefore, formed at the end wall 2 is a further working face 6 whose magnitude is determined by the inside diameter of the working face A2. It is shown at the right in FIG. 1 separately as a circular area Al. Fixed in the end wall 2 is a throttle bar or rod 60 which is arranged coaxially with respect to the passage 17 in the guide rod 15. The lower half of the throttle bar or rod 60 is of a downwardly slightly conically tapering configuration. In the downward movement of the lift piston 1 over the last section of the movement thereof of about 1 m in length, upon engaging into the passage 17, the throttle bar or rod 60 forms with the latter a throttle means. That damps the downward movement of the lift piston. Provided at the ends of the bores 21 and 23 are respective pipe rupture safety valves 68 and 69 which serve as throttle means in the event of possible occurrence of rupture of the pressure fluid lines 23 and 24.

The pressure fluid under the pressure P2 of substantially constant magnitude continuously produces on the working face A2 a constant lift force which is approximately so great that, depending on the respective requirement involved, it corresponds for example to about 90% of the mass of a cage of an elevator supported on the upper end of the lift piston 1. This part of the mass is identified in FIG. 1 by the arrow F2. Thus a part of the mass of the cage is compensated and thus is in counterweight relationship with the lift force. The pressure fluid at the variable pressure P1 which acts on the further working face A1 produces a variable lift force which corresponds to the remaining part of the load to be lifted, that is to say about 10% of the mass of the cage, the lift piston and the people in the cage. This part of the load is indicated in FIG. 1 by the arrow F1.

When the elevator has reached a holding position, the valves 33 and 43 in the pressure fluid lines 23 and 24 are put into the shut-off position so that the elevator cage remains stopped. In the downward movement of the elevator those valves are opened and, under the influence of the forces F1 due to weight and a part of the force F2 due to weight the pressure fluid is returned from the pressure chambers 7 and 13 to the tank 39 by way of the lines 23 and 24, in which case the two delivery pumps 32 and 42 are caused to rotate. Beneath a given force F1 caused by weight, the delivery pumps 32 and 42 are switched on in order to convey the pressure fluid from the pressure chambers 7 and 13 back into the tank 39 by way of the lines 23 and 24. Those valves are also opened in the upward movement of the lift piston 1.

In the embodiment shown in FIG. 2 the drive consisting of the lift piston 1, the working cylinder 10 and the guide rod 15 is of the same structure as in FIG. 1. Instead of the delivery pump 32 the FIG. 2 arrangement has a vertical additional cylinder 50 in which an additional piston 55 is sealingly guided. Mounted on the additional piston 55 is a counterweight 57 which corresponds to approximately 90% of the mass of the cage 62 which is supported on the lift piston 1. The mass is identified by M. The underside of the vertically arranged additional piston 55 forms a third working face 56 whose size is shown separately in FIG. 2 to the left beside the additional piston 55 and identified by A3. Disposed in the base 53 of the additional cylinder 50 is a bore 57 which communicates by way of a pressure fluid line 23 with the bore 21 at the working cylinder 10 and urges the pressure fluid out of the pressure chamber 54 under the working face 56 into the pressure chamber 13 of the working cylinder, more specifically at the constant pressure P2.

Once again connected to the bore 22 by way of the pressure fluid line 24 is the delivery pump 42 which supplies pressure fluid at variable pressure. An overflow line 45 branches off between the delivery pump 42 and the valve 43 and goes to the tank 39 and is provided with the excess pressure valve 47 and a make-up suction intake valve 46. On the intake side the delivery pump 42 is connected to the pressure fluid line 23 by way of a line 64. The line 64 includes a valve 63 which in its structure corresponds to the valve 43. Between the delivery pump 42 and the valve 63 an overflow line 65 branches from the line 64. The line 65 includes valves 66 and 67 corresponding to the valves 46 and 47 and leads to the tank 39.

When a load is raised, a substantially constant pressure P2 is applied by means of the counterweight 57 and the additional piston 55 to the pressure fluid which is beneath the working face 56. The pressure P2 is propagated by way of the pressure fluid line 23 and the pressure chamber 13 to the annular working face 5 at the lift piston 1 and moves that piston upwardly. In addition pressure fluid is delivered by way of the delivery pump 42 under the variable pressure P1 to the further working face Al in the interior of the lift cylinder 1, which also moves the lift piston 1 upwardly. When the elevator moves down the pressure fluid is displaced out of the two pressure chambers 7 and 13 of the drive by way of the pressure fluid line 23 and 24 respectively back into the pressure chamber 54 of the additional cylinder 50, in which case the additional piston 55 with the counterweight 57 disposed thereon moves upwardly.

In this embodiment, the tank 39 for the pressure fluid can be of substantially smaller size as a large quantity of the pressure fluid is accommodated by the additional cylinder 50. In this respect, it is possible to achieve a reduction in the drive power of up to 50% in dependence on the ratio in respect of size of the third working face A3 to the annular working face A2. A further reduction in drive power is achieved by the fact that, in the embodiment of FIG. 2, the intake side of the delivery pump 42 is connected to the pressure fluid line 23 by way of the line 64 so that the delivery pump 42 is fed with pressure fluid at constant pressure P2 and only still has to produce the pressure increase from P2 to P1.

In the embodiment shown in FIG. 3 the pressure source supplying constant pressure is advantageously integrated with the working cylinder so as to give a compact space-saving structure. For that purpose the working cylinder 10 is reduced in outside diameter in its upper portion 10' and has a stepped transition to the larger diameter in the lower portion 10". The upper reduced portion 10' is sealingly surrounded by an additional cylinder 70, on the outside of which is disposed the counterweight 57'. The upper end 71 of the additional cylinder 70 is thickened towards the upper reduced portion 10' of the working cylinder 10 and bears by way of a sliding ring seal 72 against the upper portion 10' of the working cylinder 10. Also provided at the lower end 73 of the additional cylinder 70 is a sliding ring seal 74 which bears against the lower thickened portion 10" of the working cylinder 10. Provided in the region of the stepped transition from the upper to the lower portion of the working cylinder 10 are a plurality of through holes 76 which connect the pressure chamber 13 of the working cylinder 10 to a pressure chamber 75 whose upper end face 77 is of annular shape and is delimited by the inside diameter of the additional cylinder 70 and the reduced outside diameter of the cylinder portion 10'. The same diameters also delimit an annular working face A3, shown at the right in FIG. 3, which is formed by the thickened upper end of the additional cylinder 70.

In this example the delivery pump 42 is installed in the base plate 20' of the working cylinder 10. It is connected with its intake side to the bore 23 and with its pressure side to the bore 21. Provided on each of the intake side and the pressure side of the delivery pump are respective valves 43 and 63 in the form of switching or proportional directional control valves, arranged for opening and closing the respective line.

When a load is raised by means of the drive as shown in FIG. 3 the valves 43 and 63 are opened and the additional cylinder 70 slides downwardly on the working cylinder 10 under the influence of the counterweight 57'. In that situation the pressure fluid in the pressure chamber 75, at the pressure P2, is displaced by way of the holes 76 into the pressure chamber 13 of the working cylinder 10. The pressure fluid acts on the one hand on the working face A2 at the lower end of the lift piston 1 and raises it, while on the other hand pressure fluid passes by way of the bore 21 to the intake side of the delivery pump 42 and is conveyed by same at the pressure P1 into the pressure chamber 7 of the lift piston 1. This part of the pressure fluid acts on the working face A1 and supports the upward movement of the lift piston 1.

In a lowering movement of the load, in which the valves 43 and 63 are also open, the lift piston 1 urges the pressure fluid out of the pressure chamber 7 by way of the passage 17 of the guide rod 15 and the delivery pump 42 to the internal space 13 of the working cylinder 10. The pressure fluid is then urged out of that space by way of the holes 76 into the pressure chamber 75, with the additional piston 70 again moving upwardly into the upper position shown in FIG. 3. When the drive is at rest the valves 43 and 63 are in the closed position.

The embodiment shown in FIG. 4 is modified in relation to that shown in FIG. 3 in that the working cylinder 110 is subdivided into two mutually axially displaceable portions 110' and 110", wherein the upper portion 110' is of a similar shape to the additional cylinder 70 in FIG. 3. The upper cylinder portion 110' is also of a thickened configuration at its upper end 111 and provided with a sliding ring seal 112. It slides with that end against the lift piston 1. The lower end 111 of the cylinder portion 110' is sealingly guided against the stationary lower portion 110" of the working cylinder 110, for which purpose the sliding ring seal 112 is provided in the thickened end 111 of the upper cylinder portion 110'. Enclosed between the inside diameter of the upper cylinder portion 110' and the outside diameter of the lift piston 1 is a pressure chamber 75' which is defined at the upper end by the end wall 11' which forms the annular working face A3. The counterweight 57" is fixed to the outside of the upper cylinder portion 110'. The delivery pump 42 is of the same structure and installed in the base plate 20" in the same way as in the example of FIG. 3. Accordingly the mode of operation involved is the same as that described with reference to FIG. 3, that is to say when the load is raised the upper cylinder portion 110', under the influence of the counterweight 57" urges pressure fluid at the constant pressure P2 into the pressure chamber 13 of the working cylinder 110 whereby the lift piston 1 is raised. At the same time pressure fluid passes from the pressure chamber 13 by way of the bore 23 to the delivery pump 42 which delivers it at the variable pressure P1 to the further pressure chamber 7 of the lift piston 1. That pressure fluid acts on the further working face A1 and assists with the upward movement of the lift piston. When the load is lowered the pressure fluid is urged out of the pressure chambers 7 and 13 into the pressure chamber 75' defined by the upper cylinder portion 110', in which case the pressure fluid is firstly displaced out of the pressure chamber 7 by way of the delivery pump 42 into the pressure chamber 13 before it passes to the pressure chamber 75'.

In a departure from the described examples, instead of the pressure source which supplies pressure fluid at substantially constant pressure, it is possible to use a balloon storage means or a piston storage means. The pressure sources connected to the pressure chambers 7 and 13 can also be interchanged, that is to say the pressure chamber 7 is fed with pressure fluid at constant pressure and the pressure chamber 13 is fed with pressure fluid at variable pressure. The drive described can not only be used for elevators; it can also be used for example for sliders and carriages which can be moved up and down on machine tools, lifting platforms in the case of cranes, stacker trucks, elevating platforms, active motorcar and truck shock absorbers etc.

In the case of drives with a very long stroke movement, it is possible if necessary to provide one, two or more than two spacer portions 25 and 25' and 27 which are then fixed at suitable mutual spacings in the lift piston 1 or suspended from each other by way of cables 26. Furthermore in the example of FIG. 1 the intake line of the delivery pump 42, instead of being connected to the tank 39, can be connected to the line 34 as is the case in a similar fashion in the other examples. The counter-weight 57 can be suspended directly or with cables over a roller fixed to the additional piston or additional cylinder, whereby the mass of the counterweight is halved. The electric motor 41 can be connected to a frequency converter and that can be connected to an electronic regulating circuit which then delivers control signals to the frequency converter and the valves. The valves are provided in the form of switching or proportional directional control valves which can also be controlled with pulse modulated signals. In the case of drives, it is possible to fit only one valve in the pressure fluid line 23 or 24. The filters can be fitted in the two pressure fluid lines 23 and 24 or only in one pressure fluid line 23 or 24.

What is claimed is:

1. A hydrostatic drive for raising and lowering and for holding loads in elevators, comprising a working cylinder (10) forming a first pressure chamber (13), a lift piston (1) having an interior space and sealingly guided in the working cylinder (10) and a guide rod (15) which is arranged in the working cylinder (10) and which projects into the interior space of the lift piston (1) which sealingly encloses the guide rod (15), wherein an end of the lift piston (11) which projects into the first pressure chamber (13) forms an annular end face (5) which is acted upon by pressure fluid, and in which the interior space of the lift piston (1) forms a second pressure chamber (7), and comprising at least one pump (32, 42) as a pressure fluid source with which pressure fluid can be conveyed into the pressure chambers (13, 7) and out of the pressure chambers (7, 13) and characterised in that at least one spacer ring (27') which slides on the guide rod (15) is fixed in the lift position (1) and that arranged in the working cylinder (10, 110) is at least one spacer ring (25) which slides against the guide rod (15) and the working cylinder (10, 110) and which is connected to the lift piston (1) by means of flexible tension elements (26).

2. A drive as set forth in claim 1 having a counterweight (57) for compensating for a part of the load to be raised by the lift piston (1), characterised in that the counterweight (57) is arranged on an additional cylinder (70) which sealingly surrounds the working cylinder (10, 110), forming a chamber (75) which is acted upon by pressure fluid, said chamber (75) being in communication with the first pressure chamber (13) of the working cylinder (10) and that to form the chamber (75) which is acted upon by pressure fluid, the working cylinder (10) is reduced stepwise in diameter on its outside.

3. A drive as set forth in claim 2 characterised in that the pump (42) is provided with valves (43, 63) on the intake side and the pressure side and that the pump (42) with the valves (43, 63) is disposed in the base (20', 20") of the working cylinder (10, 110).

4. A drive as set forth in claim 1 having a counterweight (57) for compensating for a part of the load to be raised by the lift piston (1), characterised in that the working cylinder (110) is subdivided into a stationary cylinder portion (110") and a movable cylinder portion (110') which is axially movable thereon and which is sealingly guided on the stationary cylinder portion (110") and which forms between itself and the lift piston (1) a chamber (75) which is acted upon by pressure fluid, and that the counterweight (57") is arranged on the axially movable cylinder portion (110').

5. A drive as set forth in claim 4 characterised in that the pump (42) is provided with valves (43, 63) on the intake side and the pressure side and that the pump (42) with the valves (43, 63) is disposed in the base (20', 20") of the working cylinder (10, 110).

6. A drive as set forth in claim 1 characterised in that provided in the interior of the lift piston (1) extending from its end receiving the load is a throttle rod (60) which upon downward movement of the lift piston (1) penetrates into a passage (17) of the guide rod (15).

7. A drive as set forth in claim 1 having a counterweight for compensating for a part of the load to be raised by the lift piston, characterised in that the counterweight (57) is arranged on an additional piston (55) which is guided in an additional cylinder (50) which is acted upon by pressure fluid and which forms a further pressure source supplying the pressure fluids with an essentially constant pressure.

8. A drive as set forth in claim 1 characterised in that a bubble storage or a piston storage supplying pressure fluid with essentially constant pressure is provided.

* * * * *